US005522633A

United States Patent [19]

Massi

[11] Patent Number: 5,522,633

[45] Date of Patent: Jun. 4, 1996

[54] MATERIAL HANDLER

[76] Inventor: Nathaniel G. Massi, 454 W. Maple Loop, LaPlace, La. 70068

[21] Appl. No.: 391,358

[22] Filed: Feb. 21, 1995

[51] Int. Cl.[6] ..... B66C 1/22

[52] U.S. Cl. ..... 294/81.52; 294/81.55; 294/67.32

[58] Field of Search ..... 294/81.5, 81.52, 294/81.55, 81.56, 67.1, 67.3, 67.32, 67.4, 81.1

[56] References Cited

U.S. PATENT DOCUMENTS

| | | | |
|---|---|---|---|
| 710,920 | 10/1902 | Morgan . | |
| 1,007,663 | 11/1911 | Atterbury . | |
| 1,762,271 | 6/1930 | Hutchings . | |
| 1,779,484 | 10/1930 | McWane . | |
| 1,833,545 | 11/1931 | Wehr . | |
| 2,213,718 | 9/1940 | Reed | 294/81 |
| 2,472,843 | 6/1949 | Muise | 294/81.55 |
| 3,024,058 | 3/1962 | Sinclair | 294/67 |
| 3,028,186 | 4/1962 | Skubic | 294/67 |
| 3,157,424 | 11/1964 | Hall | 294/67 |
| 3,443,831 | 5/1969 | Grane | 294/67 |
| 3,572,801 | 3/1971 | Howard et al. | 294/81.52 |
| 3,580,403 | 5/1971 | Lancashire | 294/67.4 |
| 4,173,334 | 11/1979 | Lombard | 294/81.5 |

FOREIGN PATENT DOCUMENTS

| | | | |
|---|---|---|---|
| 1393748 | 5/1988 | U.S.S.R. | 294/81.55 |
| 1776620 | 11/1992 | U.S.S.R. | 294/81.55 |

*Primary Examiner*—Dean Kramer
*Attorney, Agent, or Firm*—David L. Ray

[57] ABSTRACT

In accordance with the present invention there is provided an elongated central beam for supporting a load of cargo, the beam having a first end and a second end, a first cross beam connected to the first end of the central beam extending outwardly from the central beam, a second cross beam connected to the second end of the central beam extending outwardly from the central beam, rotatable arm connected to the central beam beneath each of the first and second cross beams for selective rotation from a position parallel to the elongated central beam to a position perpendicular to the elongated central beam, and a connection device for connecting the rotatable arm to the first and the second cross beams.

17 Claims, 3 Drawing Sheets

MATERIAL HANDLER

BACKGROUND OF THE INVENTION

1. Field of the Invention

The invention relates to devices for lifting and moving cargo. More particularly, the present invention relates to devices for connecting to the end of cables extending from a crane or boom for lifting heavy elongated cargo such as steel pipe and rod stock from carriers such as barges, ships, trucks, and railroad cars without bending or damaging the cargo.

2. Description of the Related Art

Material handling devices for lifting and moving elongated cargo are known in the art. Exemplary of the processes of the prior art related to material handling devices are the following U.S. Pat. Nos.: 3,443,831; 3,157,424; 3,028,186; 3,024,058; 2,213,718; 1,833,545, 1,779,484, 1,762,271; 1,007,663; and 710,920.

Commonly chains, straps or slings are placed around elongated heavy cargo such as steel pipe, rod stock, and the like to lift cargo from a barge, ship, truck, or railroad car and transfer the cargo to a storage area or other carrier, and to lift the cargo from a storage area or dock and place the cargo in a barge, ship, truck, or railroad car. However, cargo is sometimes damaged from accidental abrasions using chains, straps or slings when removing the chains or slings from the cargo after placement of the cargo in the desired location. Furthermore, conventional chains, straps, and slings are cumbersome and unwieldy, and require significant physical labor and time to position on such cargo. In addition, workers using such chains, straps, and slings to handle cargo are exposed to risk of physical injury.

SUMMARY OF THE INVENTION

In accordance with the present invention there is provided a method and apparatus for lifting and moving elongated cargo such as pipe and the like including an elongated central beam for supporting a load of cargo, the beam having a first end and a second end, a first cross beam connected to the first end of the central beam extending outwardly from the central beam, a second cross beam connected to the second end of the central beam extending outwardly from the central beam, rotatable arms connected to the central beam beneath each of the first and second cross beams for selective rotation from a position parallel to the elongated central beam to a position perpendicular to the elongated central beam, and a connection device for connecting the rotatable arms to the first and the second cross beams.

The method includes positioning an elongated beam suspended by a cable between two adjacent stacks of cargo, the beam having a top and a bottom, the beam having two cross beams connected to the top thereof perpendicularly thereto, the beam having rotatable arms connected to the bottom thereof beneath the two cross beams, rotating the rotatable arms beneath the two adjacent stacks of pipe, connecting the cross beams to the rotatable arms to enclosed each of the stacks of pipes, and lifting the elongated beam with the cable.

The present invention has the advantage of protecting cargo lifted therewith from accidental abrasions and scrapes.

Furthermore, the invention has the advantage of saving time in lifting cargo.

In addition, the present invention eliminates the use of cumbersome and unwieldy chains and straps which were used to wrap around elongated cargo to lift the cargo.

The invention also provides a safer working environment by eliminating the need for connecting and disconnecting long chains and straps completely around stacks of elongated cargo such as pipe.

DESCRIPTION OF THE PREFERRED EMBODIMENTS

Figures 1, 2:
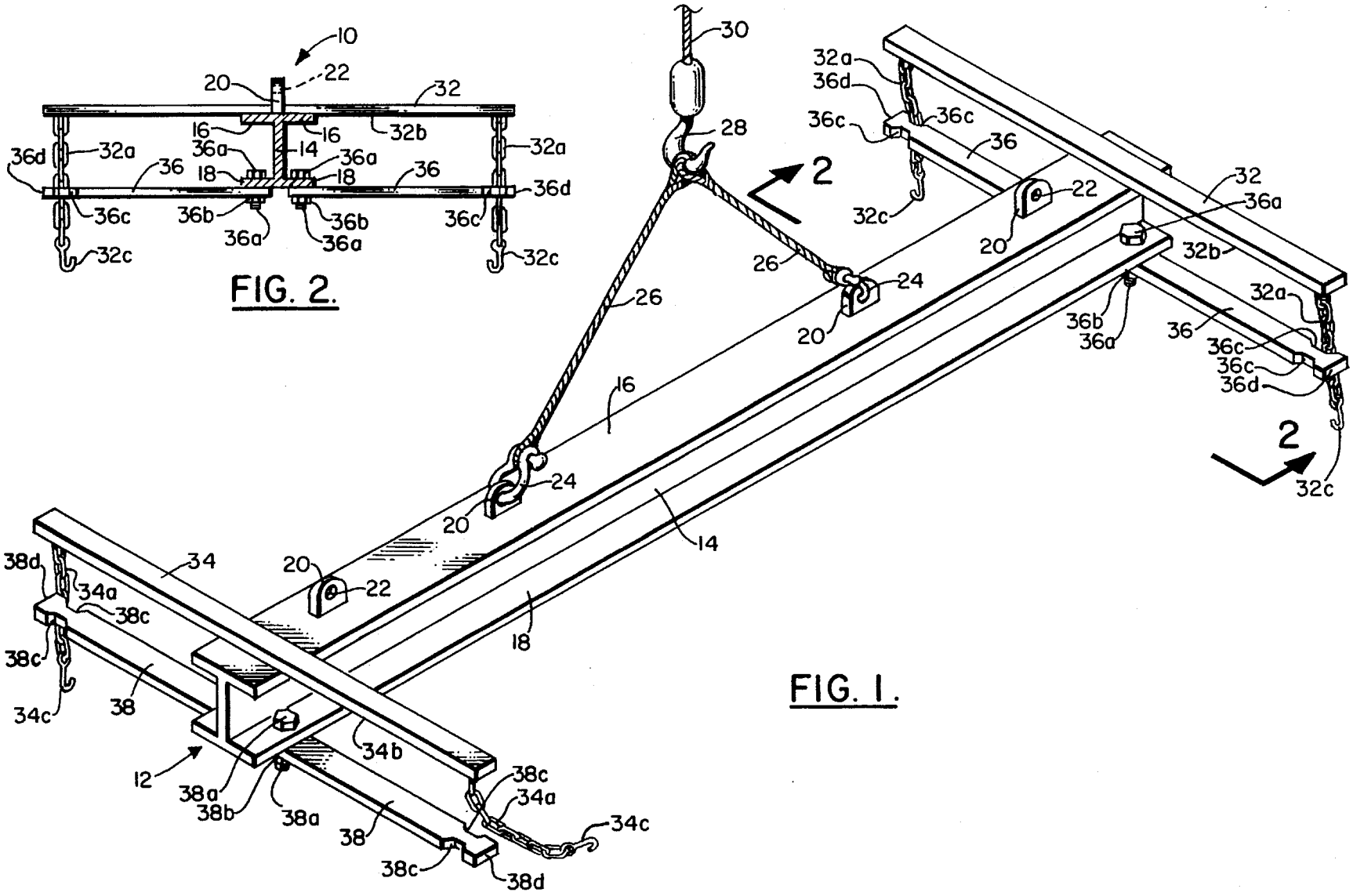
FIG. 1 is a perspective view of the material handling apparatus of the invention.
FIG. 2 is partly cross-sectional view taken along lines 2—2 of FIG. 1.

Referring now to the drawings, the material handling apparatus of the invention is generally indicated by the numeral 10. Apparatus 10 includes an elongated central beam generally indicated by the numeral 12. Central beam 12 is rigid and preferably has the shape of an I-beam, although other types of conventional beams could be used if desired such as a beam with a hollow or solid cross-section in the shape of a square rather than an "I". Central beam 12 has a web 14 rigidly connected perpendicularly to two parallel flanges 16 and 18. Preferably, flanges 16 and 18 are identical in size.

At least two lifting eyes 20—20, and preferably four lifting eyes 20—20 as shown in the drawings, extend upwardly at the top of central beam 12 from flange 16. Eyes 20—20 are rigidly connected to the top of central beam 12 at flange 16 by welding or the like. Eyes 20—20 each have a hole or channel 22 therein for receipt of hooks 24. Each of the hooks 24 are connected to one end of cables 26—26 and the other ends of cables 26—26 are connected to hook 28. Hook 28 is connected to cable 30. Cable 30 is connected to a conventional crane (not shown) or boom (not shown). Eyes 20—20 are spaced along the top of flange 16 at desired lifting points to insure appropriate distribution of lifting forces on central beam 12.

Two stationary rigid cross beams 32 and 34 are connected at the top of central beam 12 to flange 16. Preferably cross beams 32 and 34 are rigidly connected to central beam 12 by welding, bolting, or the like. Cross beams 32 and 34 could have any desired cross-section. For example, cross beams 32 and 34 could be I-beams or they could have a hollow or solid square or circular cross-section. Preferably, cross beams 32 and 34 are equal in size and shape, and are perpendicular to central beam 12.

Two chains **32*a*—32*a* and 34*a*—34*a* are connected to the bottom sides 32*b* and 34*b* of cross beams 32 and 34. Chains 32*a*—32*a* each have a hook 32*c* connected thereto, and chains 34*a*—34*a* each have a hook 34*c*** connected thereto.

Two pairs of rotatable rigid arms 36 and 38 are connected at the bottom of central beam 12 to flange 18. Preferably each of arms 36 and 38 are rotatably connected to flange 18 of central beam 12 by bolts 36*a*—36*a* and 38*a*—38*a*, respectively, and nuts 36*b*—36*b* and 38*b*—38*b*, respectively. However, other devices known in the art may be used if desired, such as pins and the like.

Figure 3:
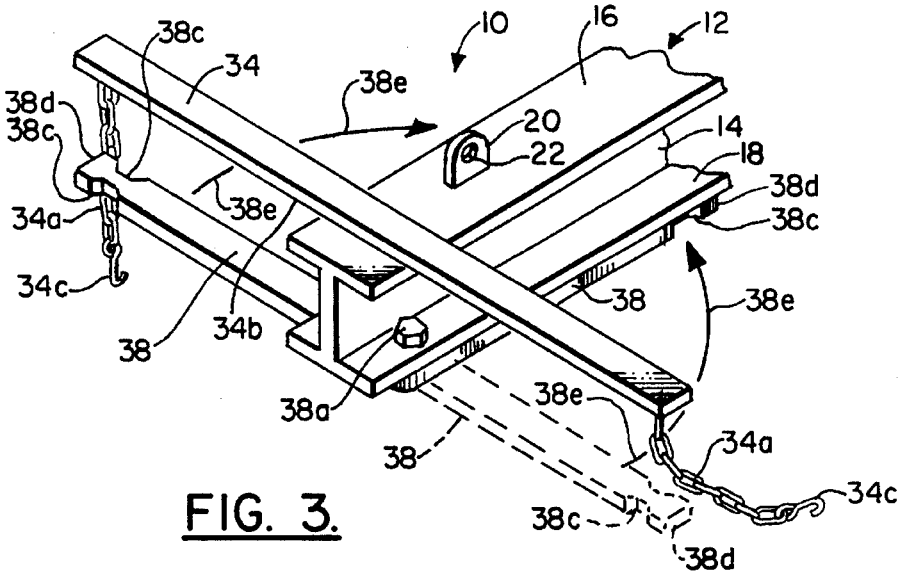
FIG. 3 is a partly cut-away, perspective view of a portion of FIG. 1.

Rotatable arms 36 and 38 could have any desired cross-section. For example, arms 36 and 38 could be I-beams or they could have a square or circular cross-section. Preferably, rotatable arms 36 and 38 are equal in size and shape, and rotate about bolts 36*a* and 38*a* in a plane parallel the planes in which flanges 16 and 18 lie as shown by the arrows 38*e*—38*e* in FIG. 3.

Rotatable arms 36 and 38 preferably extend outward from flange 18 a distance less than, or equal to, the distance cross beams 32 and 34 extend outward from flange 16. The vertical distance between cross beam 32 and rotatable arms 36—36 and between cross beam 34 and rotatable arms 38—38 may be selected as desired. If an I-beam is chosen as central beam 12, the vertical distance between cross beam 32 and rotatable arms 36—36 and between cross beam 34 and rotatable arms 38—38 may be selected by choosing an I-beam having the depth or height of web 14 plus the thickness of flanges 16 and 18 to be equal to the desired vertical distance between cross beam 32 and rotatable arms 36—36 and between cross beam 34 and rotatable arms 38—38.

Preferably, two notches 36*c*—36*c* are located in each outer end 36*d*—36*d* of rotatable arms 36—36, and two notches 38*c*—38*c* are located in each outer end 38*d*—38*d* of rotatable arms 38—38. Notches 36*c*—36*c* receive chains 32*c*—32*c*, and notches 38*c*—38*c* receive chains 34*c*—34*c* when cargo such as pipe 40 shown in FIGS. 5 and 6 is being lifted with material handling apparatus 10.

Preferably, all of the components of the present invention are made from a rigid material such as steel. Various alloys of steel known in the art may be used as desired.

Figure 4:
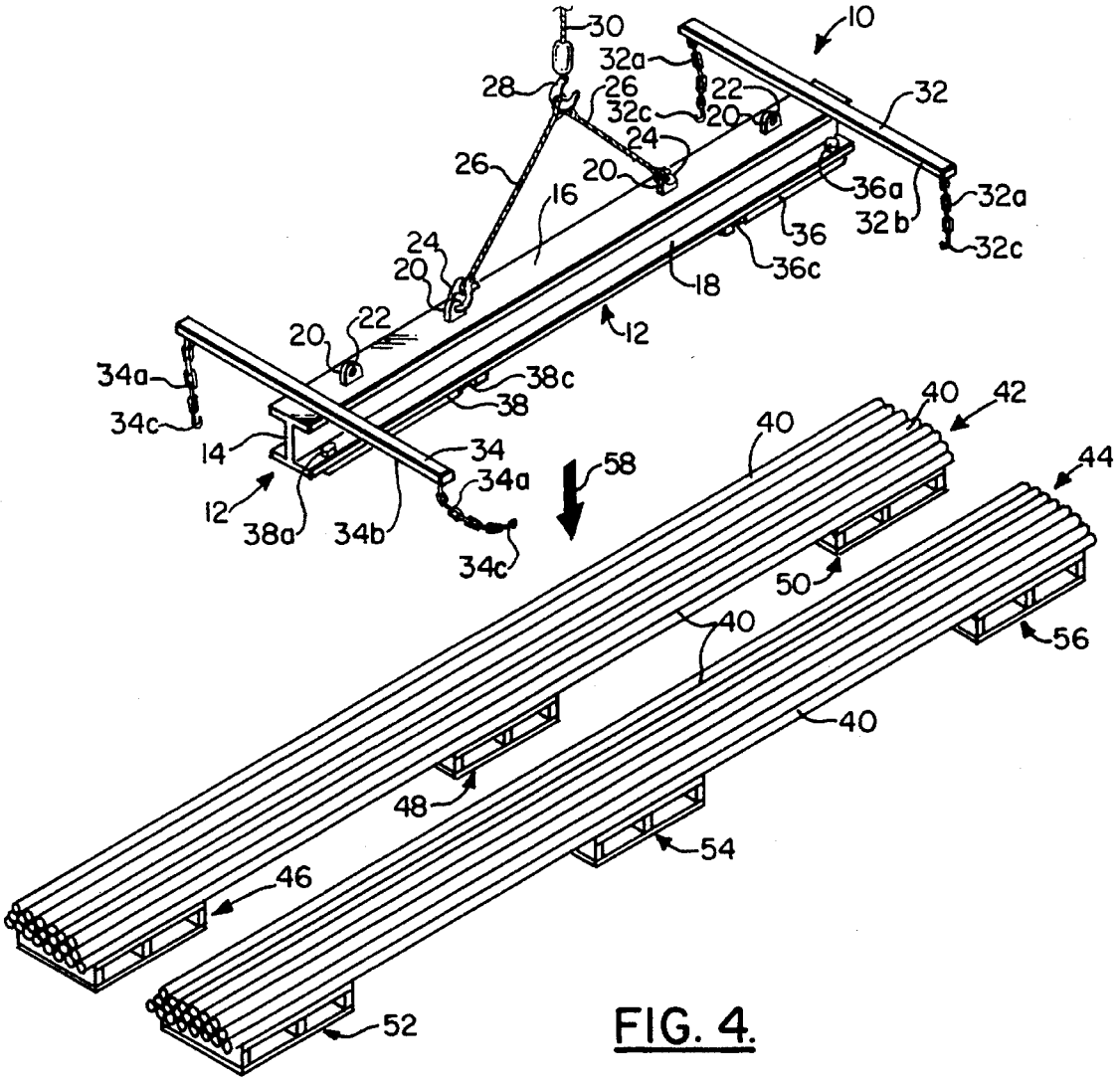
FIG. 4 is a perspective view of the material handling apparatus of the invention positioned above cargo to be connected to said apparatus.
Figure 5:
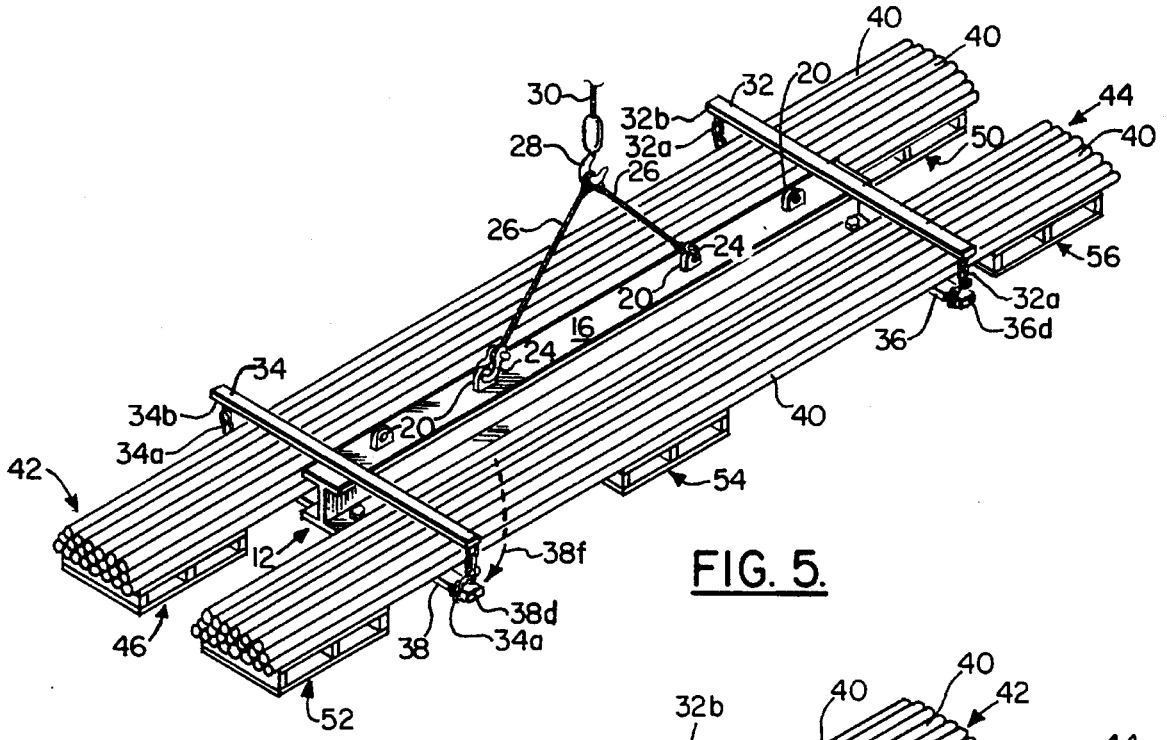
FIG. 5 is a perspective view of the material handling apparatus of the invention connected to cargo to be lifted.
Figure 6:
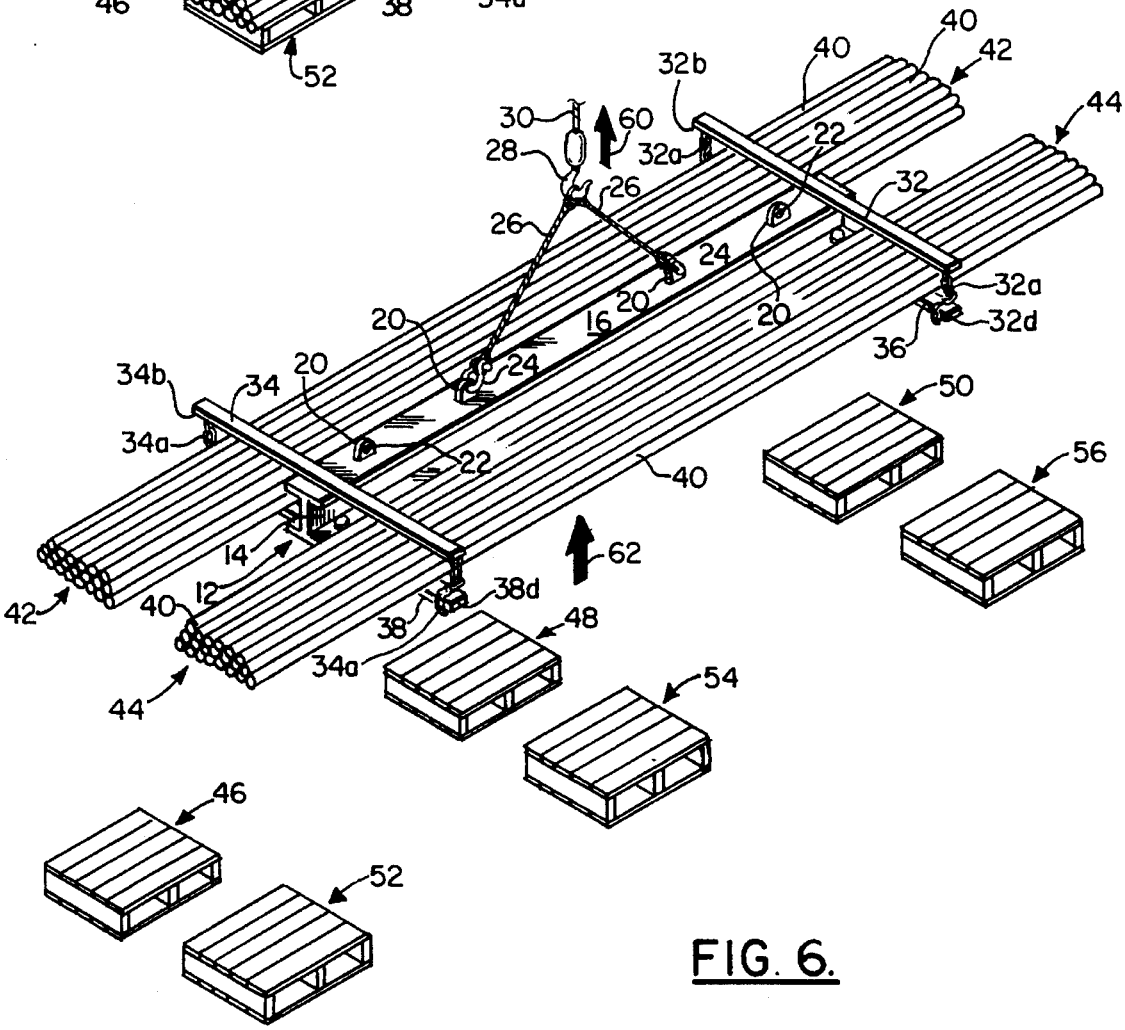
FIG. 6 is a perspective view of the material handling apparatus of the invention lifting cargo connected thereto.

In FIGS. 4, 5, and 6 elongated cargo such as pipe 40 is shown stacked in two stacks generally indicated by the numerals 42 and 44. Stack 42 rests on pallets 46, 48 and 50, and stack 44 rests on pallets 52, 54, and 56. The pallets may be resting on the bottom or deck of a barge or ship, or on a truck, railroad car, loading dock or the like.

To utilize the material handling apparatus 10 of the invention to lift and move stacks 42 and 44 of pipe 10, rotatable arms 36—36 and 38—38 are folded inwardly beneath flange 18 generally parallel to web 14 and generally perpendicular to cross beams 32 and 34 as shown in FIG. 4. Material handling apparatus 10 is then lowered by lowering cable 30 in the direction indicated by the arrow 58 in FIG. 4 to the position between stacks 42 and 44 shown in FIG. 5.

In FIG. 5 the cross beams 32 and 34 rest on top of stacks 42 and 44. Rotatable arms 36—36 and 38—38 are then rotated from the position shown in FIG. 4 to the position shown in FIG. 5 underneath stacks 42 and 44 between adjacent pallets to a position wherein the arm are generally perpendicular to central beam 12. The direction of rotation of one of the rotatable arms 38 is shown in FIG. 5 by the arrow 38*f*. The vertical distance between cross beam 32 and rotatable arms 36—36 and between cross beam 34 and rotatable arms 38—38 is greater than the distance between the top of stacks 42 and 44 and the top of the pallets 46, 48, 50, 52, 54, and 56.

After each of the rotatable arms 36—36 and 38—38 are rotated perpendicular to central beam 12 as shown in FIG. 5, each of the chains 32*a*—32*a* are wrapped tightly around each of the notches 36*c*—36*c* of rotatable arms 36—36 and each of the hooks 32*c*—32*c* are hooked around each of the chains 32—32 after wrapping in notches 36*c*—36*c* to secure the ends 36*d*—36*d* of arms 36—36 to the adjacent end of cross beam 32. Each of the chains 34*a*—34*a* are wrapped tightly around each of the notches 38*c*—38*c* of rotatable arms 38—38 and each of the hooks 34*c*—34*c* are hooked around each of the chains 34—34 after wrapping in notches 38*c*—38*c* to secure the ends 38*d*—38*d* of arms 38—38 to the adjacent end of cross beam 34.

Having secured each stack 42 and 44 of pipe 40 to material handling apparatus 10 as shown in FIG. 5, the stacks 42 and 44 may be lifted upwardly as shown in FIG. 6 in the direction indicated by the arrows 60 and 62 by retracting cable 30. As cable 30 is retracted or lifted upward, central beam 12 is lifted and rotatable arms 36—36 and 38—38 contact the bottom of stacks 42 and 44 of pipe 40 to provide an upward, lifting force to stacks 42 and 44. Pipe 40 is prevented from rolling off rotatable arms 36—36 and 38—38 by chains 32*a*—32*a* and 34*a*—34*a*, and by central beam 12.

If desired chains 32*a*—32*a* and chains 34*a*—34*a* could be replaced with any desired device to selectively connect and disconnect beams 32 and 34 to adjacent movable arms 36—36 and 38—38. For example, a hook could be rotatably connected to each end of beams 32 and 34 to selectively engage and hold rotatable arms 36—36 and 38—38.

Although the preferred embodiments of the invention have been described in detail above, it should be understood that the invention is in no sense limited thereby, and its scope is to be determined by that of the following claims:

What is claimed is:

1. An apparatus for lifting cargo comprising:

a. an elongated central beam means for supporting a load of cargo, said beam means having a first end and a second end, said central beam having a top and a bottom, b. a first cross beam connected to said top of said first end of said central beam means extending outwardly from said central beam means, c. a second cross beam connected to said top of said second end of said central beam means extending outwardly from said central beam means, d. rotatable arm means connected to said bottom of said central beam means beneath each of said first and second cross beams for selective rotation from a position parallel to said elongated central beam means to a position perpendicular to said elongated central beam means, and e. connection means for connecting said rotatable arm means to said first and said second cross beams.

2. The apparatus of claim 1 wherein said rotatable arm means contact the bottom of cargo to be lifted and apply an upward force to said cargo to be lifted.

3. The apparatus of claim 1 wherein said central beam is an I-beam.

4. The apparatus of claim 1 wherein said rotatable arm means comprise a plurality of rigid arms having a first end and a second end.

5. The apparatus of claim 4 wherein said first end of each of said plurality of rigid arms is rotatably connected to said central beam means.

6. The apparatus of claim 5 wherein said second end of each of said rotatable arms has notch means therein for receipt of said connection means.

7. The apparatus of claim 6 wherein said connection means is a plurality of chains, each of said plurality of chains being connected to said cross beams.

8. The apparatus of claim 7 wherein each of said plurality of chains has a hook connected thereto.

9. The apparatus of claim 8 wherein said plurality of rigid arms are four in number.

10. The apparatus of claim 9 wherein said plurality of chains are four in number.

11. An apparatus for lifting cargo comprising:

a. an elongated central rigid beam for supporting a load of cargo, said beam having a first end and a second end and a top and a bottom, b. a first cross beam connected perpendicularly to said top of said first end of said central beam, said first cross beam extending outwardly from said central beam means, c. a second cross beam connected perpendicularly to said top of said second end of said central beam, said second cross beam extending outwardly from said central beam, d. four rotatable arms rotatably connected to said bottom of said central beam means beneath each of said first and second cross beams, each of said four rotatable arm means being rotatable from a position parallel to the longitudinal axis of said elongated central beam means to a position perpendicular to said longitudinal axis of said elongated central beam, and e. connection means for connecting said rotatable arm means to said first and said second cross beams.

12. The apparatus of claim 11 wherein each of said rotatable arms has a first end and a second end, said first end of each of said plurality of rigid arms being rotatably connected to said bottom of said central beam.

13. The apparatus of claim 12 wherein said second end of each of said rotatable arms has notch means therein for receipt of said connection means.

14. The apparatus of claim 13 wherein said connection means comprises a plurality of chains, one of said plurality of chains being connected to each end of each of said cross beams.

15. The apparatus of claim 14 wherein each of said plurality of chains has a hook permanently connected thereto for hooking to said chain after wrapping said chain around said notch means.

16. A method for lifting two adjacent stacks of elongated cargo comprising:

a. positioning an elongated beam suspended by a cable between said two adjacent stacks, said beam having a top and a bottom, said beam having two cross beams connected to said top thereof perpendicularly thereto, said beam having rotatable arms connected to the bottom thereof beneath said two cross beams, b. rotating said rotatable arms beneath said two adjacent stacks of pipe, c. connecting said cross beams to said rotatable arms to enclosed each of said stacks of pipes, and d. lifting said elongated beam with said cable.

17. The method of claim 16 wherein said cross beams are connected to said rotatable arms to hold said cargo between said cross beams and said rotatable arms.

* * * * *